United States Patent [19]

Voss

[11] 4,109,602

[45] Aug. 29, 1978

[54] HAWSER HOOK

[75] Inventor: Siegfried Voss, Bremerhaven-W., Fed. Rep. of Germany

[73] Assignee: Aktien-Gesellschaft "Weser", Bremen, Fed. Rep. of Germany

[21] Appl. No.: 752,846

[22] Filed: Dec. 21, 1976

[30] Foreign Application Priority Data

Dec. 24, 1975 [DE] Fed. Rep. of Germany ..... 2558746

[51] Int. Cl.[2] ..... B63B 21/04

[52] U.S. Cl. ..... 114/218; 114/230; 294/84

[58] Field of Search ..... 294/83 R, 84; 24/115 K, 24/230.5 R, 230.5 AP; 48/218; 114/218, 230, 231, 221, 223, 210, 235 R, 235 WS, 235 A, 235 B, 235 F

[56] References Cited

U.S. PATENT DOCUMENTS

| | | | |
|---|---|---|---|
| 2,861,535 | 11/1958 | Hutchinson | 114/218 |
| 3,045,634 | 7/1962 | Dorsett | 294/83 R |
| 3,259,418 | 7/1966 | Munday | 294/84 |

FOREIGN PATENT DOCUMENTS

| | | | |
|---|---|---|---|
| 949,727 | 6/1974 | Canada | 24/230 AP |
| 1,149,476 | 12/1957 | France | 114/218 |

*Primary Examiner*—Trygve M. Blix

*Assistant Examiner*—D. W. Keen

*Attorney, Agent, or Firm*—Michael J. Striker

[57] ABSTRACT

A hawser hook for use in morning ships to piers and similar mooring structures includes an anchoring element rigidly connected to a mooring structure, a hub mounted on the anchoring element for rotation thereabout, a hook frame mounted on the hub for pivoting along a plane normal to the mooring structure, a hook member mounted on the hook frame for pivoting between an engaging and a disengaging position, and an arresting arrangement for releasably arresting the hook in its engaging position in which a hawser or a similar mooring line may engage the hook member. The hook frame is supported on the hub in such a manner that it is suspended therefrom in a position in which it is immediately adjacent with spacing from the exposed surface when no external force is applied to the hook member while application of a force abuts the free end of the hook frame against the mooring structure. The support arrangement serving this purpose includes support members one on the frame and another on the hub, and a resilient member intermediate such support portion members, which yields when load is applied to the hook member. An abutment member separate from the hook frame is connected thereto and abuts the mooring structure when the hook member is loaded.

10 Claims, 4 Drawing Figures

HAWSER HOOK

BACKGROUND OF THE INVENTION

The present invention relates to a mooring arrangement in general and more particularly to a hawser hook which is to be used for mooring ships to piers, or similar mooring structures.

It has been already proposed to so construct hawser hooks, with which hawsers or like mooring lines are to be engaged to moor ships to piers or similar mooring structures, that they include a respective anchoring element which is connected to and extends upwardly of the mooring structure, a hub mounted on the anchoring element for rotation thereabout, a hook frame mounted on the hub for pivoting toward and away from the mooring structure along a substantially vertical plane, a hook member mounted on the hook frame for pivoting between an engaging position in which a hawser can be engaged therewith, and a disengaging position, and an arresting arrangement which arrests the hook member in its engaging position for quick release.

The hook frame of such proposed hawser hook is usually elongated and has a pair of lateral mounting portions parallel to the above-mentioned plane, the hook frame being connected to the hub for pivoting about a horizontal axis and for rotation therewith about the vertical axis of the anchoring element. The anchoring element, in turn, is connected to a base which is embedded in or otherwise immovably connected to the mooring structure. The free end of the hook frame, which is spaced from the region at which the hook frame is pivoted on the hub, abuts against the exposed surface of the mooring structure so that, then the hub rotates with the hook frame about the above-mentioned vertical axis, the free end of the hook frame glides over the exposed surface of the mooring structure. In order to avoid unnecessary damage, to facilitate the sliding, and to prevent possible blockage, it has been already proposed to arrange a slide member of sheet material at the exposed surface of the mooring structure around the anchoring element and particularly in the region where the free end of the hook frame would otherwise come into contact with the exposed surface of the mooring structure. The provision of such a support member on the exposed surface of the mooring structure considerably increases the cost of manufacturing and assembling the hawser hook.

There have also been proposed hawser hooks for use in towing ships, in which the hook frame is directly connected to a pillar-shaped anchoring element and is supported in an inclined position by a supporting cage, a supporting member or a similar arrangement; however, such hooks are only suited for use where the loading of the hawser hook is much smaller than the loading to which hawser hooks designed to moor ships to mooring structures are subjected.

When it was attempted to utilize a similar principle in a hawser hook for mooring ships to mooring structures, such as piers, wharfs and the like it has been established that the above-mentioned sliding member is indispensable if it is desired to avoid damage to the mooring structure. This, of course, is very disadvantageous in that, as already explained above, such sliding member or plate is a rather expensive proposition.

SUMMARY OF THE INVENTION

Accordingly, it is a general object of the present invention to avoid the disadvantages of the prior art.

More particularly, it is an object of the present invention to provide a hawser hook for use in mooring ships to piers and similar mooring structures which is not possessed of the disadvantages of the prior art hawser hooks.

Still another object of the present invention is to provide a hawser hook which is simple in construction, inexpensive to manufacture and to mount on the mooring structure, and reliable in operation nevertheless.

A concomitant object of the present invention is to so contruct the hawser hook that sliding contact thereof with the exposed surface of the mooring structure is avoided when no external force is applied to the hawser hook.

In pursuance of these objects and others which will become apparent hereafter, one feature of the present invention resides, briefly stated, in a hawser hook particularly for use in mooring ships to piers and similar mooring structures, which comprises an anchoring element rigidly connected to a respective mooring structure and projecting from an exposed surface of the latter, a hook element having a mounting portion and a free portion spaced from said mounting portion; means for mounting said hook element in said anchoring element for movement at least toward and away from the exposed surface; and means for so supporting said hook element that the same is suspended from said anchoring element immediately adjacent and with spacing from the exposed surface when no external force is applied thereto while said free portion thereof abuts the exposed surface upon loading thereof. Preferably, the hook element includes a frame having the above-mentioned portions, a hook member adapted to be engaged by a hawser, and means for connecting the hook member to the frame. The above-mentioned connecting means mounts the hook member on the frame for pivoting about a pivot axis substantially parallel to the exposed surface between an engaging and disengaging position, and an arresting means is provided which arrests the hook member in the engaging position thereof.

This arrangement renders it possible for the hawser hook to conduct a rotational movement about an axis normal to the exposed surface of the support structure, without being in a sliding contact with such an exposed surface, provided that no external forces are applied to the hawser hook. Thus, the previously required slide plate or a similar slide member can be dispensed with, as well as the means and operations which are necessary to mount such a slide member on the mooring structure. The cost saving both in terms of material and manhours is considerable. The operation of the hawser hook is improved and the handling thereof is facilitated.

The support means may include two support portions provided on said hook element and said anchoring element, respectively, and abutting one another, at least one of such support portions being resiliently yieldable. In a currently preferred embodiment of the present invention, the mounting means includes a hub mounted on said anchoring element for rotation about an axis substantially normal to the exposed surface, and a pivot mounting said hook element on said hub for pivoting about another axis which is substantially parallel to the exposed surface. Under these circumstances, the support means includes two support portions which are provided on the hook element and the hub, respectively, and which engage one another. Then, the support means includes a resiliently yieldable portion which yields when the hook element is loaded to permit the free end portion of the latter to abut the exposed surface. Preferably, the resiliently yieldable portion is a member of elastic material which is compressed when load is applied to the hawser hook.

It is also advantageous as proposed by the present invention to provide the hook element with an abutment region which is adapted to abut the exposed surface upon loading of the free portion of the hook element. This abutment region may be constituted by an abutment member which is separate from and connected to the free portion of the hook element, the abutment member being of a wear-resistant material or of a resiliently yieldable material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DISCUSSION OF THE PREFERRED EMBODIMENTS

Figure 1:
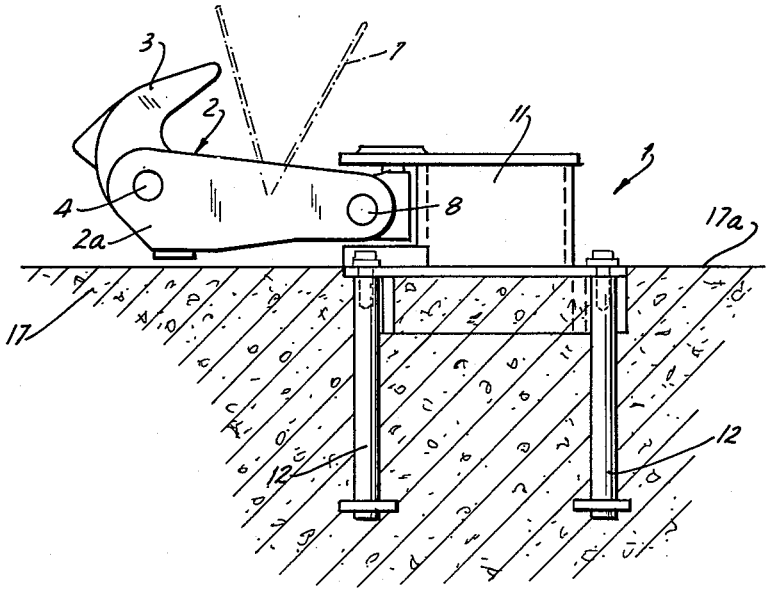
FIG. 1 is a diagrammatic side elevational view of a hawser hook of the present invention as mounted on an anchoring element and in an unloaded position
Figure 2:
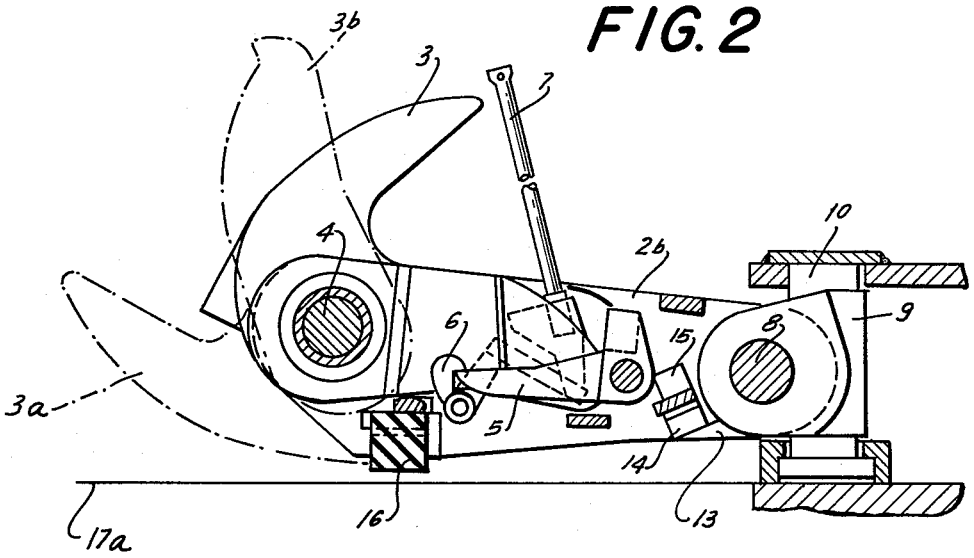
FIG. 2 is a longitudinal sectional view through the hook frame of the hawser hook of FIG. 1, at an enlarged scale.
Figure 3:
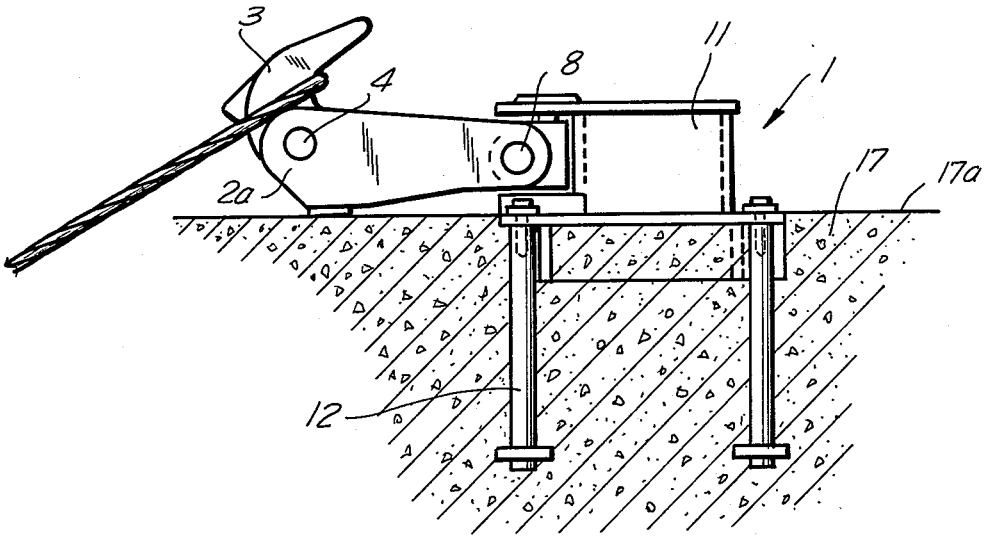
FIG. 3 is a view similar to FIG. 1 but in a loaded condition.

Referring now to the drawing, and first to FIGS. 1 and 3 thereof, it may be seen that the reference numeral 17 indicates a mooring structure, such as a pier, which has an exposed surface 17*a*. A hawser hook designated in toto with the reference numeral 1 is mounted on the mooring structure 17 at the exposed surface 17*a* thereof. The hawser hook 1 includes a hook frame 2 having lateral portions 2*a* and 2*b*, respectively. A hook member 3 is mounted on the lateral portions 2*a* and 2*b* of the hook frame 2 for pivoting, by means of a pivot 4 which extends parallel to the exposed surface 17*a* of the mooring structure 17. The hook member 3 has two arms 3*a* and 3*b*. The hook member 3,as particularly seen in FIG. 2, may assume an engaging position illustrated in full lines,and a disengaging position illustrated in dash-dotted lines. An arresting arrangement 5, 6 acts on the arm 3*b* in the engaging position and arrests the same in such an engaging position, a lever 7 being provided which releases the arresting arrangement 5, 6 to permit the hook member 3 to move towards its disengaging position. The arresting arrangement 5, 6 and the connection of the lever 7 thereto are all conventional and not necessary for an understanding of the present invention, so that it is not necessary to discuss the members 5, 6 and 7 in detail. Moreover, a different conventional arresting arrangement could be used instead of the arrangement 5, 6 and 7.

One end, in the drawing the right end, of the hook frame 2 is mounted on a pivot 8 which, in turn, is mounted on a hub 9, the pivot 8 mounting the hook frame 2 on the hub 9 for pivoting about an axis parallel to the exposed surface 17*a* of the mooring structure 17. The hub 9 is mounted on a pivot 10 for rotation about an axis substantially normal to the exposed surface 17*a* of the mooring structure 17. The pivot 10 is supported on a domeshaped anchoring member 11 or a similar anchoring member which is connected to a base embedded in the mooring structure 17. Thus, the hook frame 2 is movable both in a direction parallel to and normal to the exposed surface 17*a* of the mooring structure 17.

Figure 4:
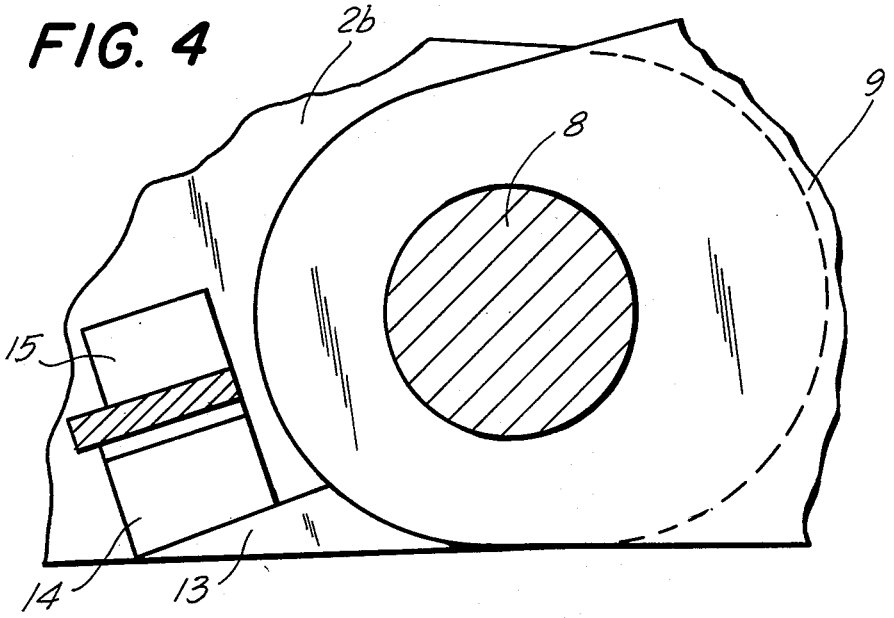
FIG. 4 is a view similar to FIG. 2 of a detail thereof, at a yet more enlarged scale.

If the movement of the hook frame 2 about the pivot 8 were unrestrained, the free end of the hook frame 2 would rest on the exposed surface 17*a* of the mooring structure 17 as illustrated in FIG. 3, whether or not any external forces have been applied to the hook member 3, such forces usually resulting from the attachment of a hawser or a similar mooring line to the hook member 3. However, it is proposed according to the present invention to keep the hook frame 2 in its suspended position illustrated in FIG. 1 when the hook member 3 is not subjected to external forces so that the hawser hook 1 can be rotated both about the pivot 8 and about the pivot 10. To keep the hook frame 2 in the suspended position, a support portion 13, as particularly seen in FIG. 4, is provided on the hub 9, and a cooperating support portion 15, shown partially in cross-section is provided on the hook frame 2. A resiliently yieldable member 14 is arranged between the support portions 13 and 15. The resiliently yieldable member 14 spaces the support portions 13 and 15 from one another when no external forces are applied to the member 3 or to the hook frame 2, and is compressed when such external forces are applied to the hook member 3 or to the hook frame 2 to permit the free end of the hook frame 2 to abut against the exposed surface 17*a* of the mooring structure 17. Preferably, the support portions 13, 15 and the resiliently yieldable member 14 are arranged intermediate the lateral portions 2*a*, 2*b* of the hook frame 2.

An abutment member 16 is connected to the free end of the hook frame 2, preferably also intermediate the lateral portions 2*a*, 2*b* thereof, such abutment member 16 abutting the exposed surface 17*a* of the mooring structure 17 when the hawser hook 1 is subjected to external forces acting toward the mooring structure 17. This abutment member 16 may be of any desirable material which is coordinated to the conditions prevailing in the environment of the hawser hook 1 and to the demands put on the abutment member 16. So, for instance, the abutment member 16 may be of a wear-resistant material, an elastic material, and so forth.

As mentioned above, the member 14 is of a resiliently yieldable material. For hawser hooks 1 to be used in applications in which relatively small external forces are applied to the hook member 3, the yieldability of the member 14 will have to be pronounced. However, when the forces applied to the hook member 3 by the hawser or the like are considerable, it will be sufficient if the support portion 13 and the member 14 are of steel, which will have sufficiently high resiliency to permit the abutment of the free end of the hook frame 2 or of the abutment member 16 mounted thereon, with the exposed surface 17*a* of the mooring structure 17.

It will be understood that each of the elements described above, or two or more together, may also find a useful application in other types of constructions differing from the types described above.

While the invention has been illustrated and described as embodied in a hawser hook, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A hawser hook, particularly for use in mooring ships to piers and similar mooring structures, comprising an anchoring element rigidly connected to a respective mooring structure and projecting from an exposed surface of the latter; a hook element having a mounting portion and a free portion spaced from said mounting portion; means for mounting said hook element on said anchoring element for movement at least toward and away from the exposed surface; and means for so supporting said hook element that the same is suspended from said anchoring element immediately adjacent and with spacing from the exposed surface when no external force is applied thereto while said free portion thereof abuts the exposed surface upon loading thereof.

2. A hook as defined in claim 1, wherein said hook element includes a frame having said portions, a hook member adapted to be engaged by a hawser, and means for connecting said hook member to said frame.

3. A hook as defined in claim 2, wherein said connecting means mounts said hook member on said frame for pivoting about a pivot axis substantially parallel to the exposed surface between an engaging and a disengaging position; and wherein said hook element further includes arresting means for arresting said hook member in said engaging position thereof.

4. A hook as defined in claim 1, wherein said support means includes two support portions provided on said hook element and said anchoring element, respectively, and abutting one another.

5. A hook as defined in claim 1, wherein said mounting means includes a hub mounted on said anchoring element for rotation about an axis substantially normal to the exposed surface, and a pivot mounting said hook element on said hub for pivoting about another axis which is substantially parallel to the exposed surface; and wherein said support means includes two support portions provided on said hook element and said hub, respectively, and engaging one another.

6. A hook as defined in claim 1, wherein said support means includes a resiliently yieldable portion which yields when said hook element is loaded to permit said free portion of the latter to abut the exposed surface.

7. A hook as defined in claim 1, wherein said hook element has an abutment region adapted to abut the exposed surface upon loading of said free members of said hook element.

8. A hook as defined in claim 7, wherein said abutment region is constituted by an abutment member separate from and connected to said free portion of said hook element.

9. A hook as defined in claim 8, wherein said abutment member is of a wear-resistant material.

10. A hook as defined in claim 8, wherein said abutment member is of a resiliently yieldable material.

* * * * *